US008512355B2

(12) United States Patent
Samonigg et al.

(10) Patent No.: US 8,512,355 B2
(45) Date of Patent: Aug. 20, 2013

(54) EPILATOR

(75) Inventors: Gert Samonigg, Wolfsberg (AT); Hubert Petz, Drachten (AT); Juergen Holzbauer, Maria Rain (AT)

(73) Assignee: Koninklijke Philips N.V., Eindhoven (NL)

( * ) Notice: Subject to any disclaimer, the term of this patent is extended or adjusted under 35 U.S.C. 154(b) by 707 days.

(21) Appl. No.: 11/909,745

(22) PCT Filed: May 1, 2006

(86) PCT No.: PCT/IB2006/051349

§ 371 (c)(1), (2), (4) Date: Sep. 26, 2007

(87) PCT Pub. No.: WO2006/117744

PCT Pub. Date: Nov. 9, 2006

(65) Prior Publication Data

US 2008/0228197 A1 Sep. 18, 2008

(30) Foreign Application Priority Data

May 2, 2005 (EP) ..... 05103636
Sep. 12, 2005 (EP) ..... 05108332

(51) Int. Cl.
*A61B 17/50* (2006.01)

(52) U.S. Cl.
USPC ..... 606/133

(58) Field of Classification Search
USPC ..... 606/131, 133, 210, 211; 524/13, 524/35–58, 413, 430, 437, 494
See application file for complete search history.

(56) References Cited

U.S. PATENT DOCUMENTS

| | | | | |
|---|---|---|---|---|
| 3,835,089 | A * | 9/1974 | Fox et al. | 524/86 |
| 5,041,123 | A | 8/1991 | Oliveau | |
| 5,783,624 | A * | 7/1998 | Khanarian et al. | 524/494 |
| 5,889,102 | A * | 3/1999 | Haack et al. | 524/494 |

FOREIGN PATENT DOCUMENTS

| | | | |
|---|---|---|---|
| EP | 0443914 | | 8/1991 |
| FR | 2675354 | | 10/1992 |
| JP | 49052248 | A | 5/1974 |
| JP | 9272802 | A | 10/1997 |
| WO | 8103121 | | 11/1981 |
| WO | 0132048 | | 5/2001 |

* cited by examiner

*Primary Examiner* — Ryan Severson
*Assistant Examiner* — Ashley Cronin

(57) ABSTRACT

The invention relates to an epilator (10) comprising tweezers elements (12). In accordance with the invention at least the surfaces of the tweezers elements (12) are at least in part made of a basic material reinforced with a filling material for at least 30%, the filling material comprising a hardness of at least 3 on Moh's hardness scale.

10 Claims, 3 Drawing Sheets

EPILATOR

The present invention relates to an epilator comprising tweezers elements for removing hair.

Figure 5:
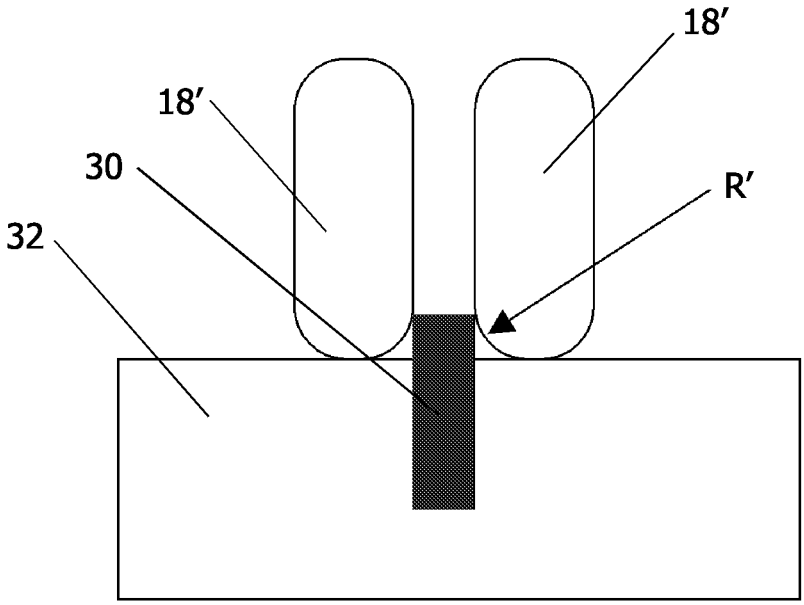
FIG. 5 (Prior Art)

Without being limited thereto, the tweezers elements can be formed by rotating discs as it is for example known from WO 01/32048 A1 which hereby is incorporated by reference. It is for example known to use tweezers elements made of metal. However, the skin contact surfaces of common metal tweezers are smooth and, due to the slip stick effect on the skin, the epilator needs more power and the feeling on the skin is unpleasant. This is particularly due to the fact that most metal tweezers comprise a small thickness which increases the scratching feeling on the skin. Furthermore, due to the production technology of metal tweezers (stamping and rounding to eliminate the burrs) the metal tweezers comprise relative big tweezers radii, and this leads to a bad catching performance for short hair as it is illustrated in FIG. 5. FIG. 5 schematically shows two rotating discs 18' forming a tweezers. As illustrated, the discs 18' are intended to remove hair 30 from skin 32. As may be seen, the discs 18' comprise radii R' which are relative big, for example in the range of 0.1. These problems are reduced, if injected moulded tweezers are used, as proposed for example in WO 01/32048 A1 incorporated by reference herein. To provide the necessary stiffness for injection moulded tweezers it is already known, for example from U.S. Pat. No. 5,041,123, to use a plastic material reinforced with glass fibres or the like. From experiments it can be seen that the filling material, for example glass fibres, has to be present with about 20% by weight (all percent values mentioned herein are percent by weight values) to provide the necessary stiffness.

It is the object of the invention to further develop the epilators of the type mentioned at the beginning such that the hair removing function is enhanced while the feeling on the skin becomes more pleasant.

This object is solved by the features of claim 1. Further developments and preferred embodiments of the invention are outlined in the dependent claims.

In accordance with the invention there is provided an epilator comprising tweezers elements, wherein at least the surfaces of the tweezers elements are at least in part made of a basic material reinforced with a filling material for at least 30%, the filling material comprising a hardness of at least 3, preferably more than 5, and most preferably more than 7 on Moh's hardness scale. Surprisingly it has been shown that the hair removing function is enhanced while the feeling on the skin becomes more pleasant, if the filling material is present with a percentage significantly higher than necessary to provide the mechanical stability. The high percentage of filling material leads to a rough surface of the tweezers, and this improves the grip of hair and the skin friction properties, especially for thicker tweezers. During application tests it was recognized that the epilator in accordance with the invention leads to a smooth feeling on the skin, for example compared to epilators comprising metal discs which are always scratching. If the surface roughness is increased even more, an additional peeling effect can be provided, for example in order to prevent ingrowth of hair. If prior art epilators are used with additives, the grip of the smooth tweezers decreases significantly. The epilator in accordance with the invention comprises tweezers that have a rough, stiff surface and can grip hair also under wet conditions while the shape of the tweezers is maintained. Non or low filled tweezers can swell when used with additives or during washing, and this might lead to problems for the drive system. The filling material can be a single material or a material mixture.

It is preferred that the basic material is reinforced with the filling material for 30% to 90%, preferably for 50% to 80%, and most preferably for 60% to 70%. As mentioned above, all percentage values mentioned herein relate to percent by weight.

Furthermore, it is preferred that the basic material reinforced with the filling material on Moh's hardness scale comprises a hardness between 3 and 10, preferably between 4 and 9, and most preferably between 6 and 8. For example, very good results were obtained if the hardness is 8 on Moh's hardness scale, i.e. if the basic material reinforced with the filling material is harder than steel which comprises a hardness of 7 on Moh's hardness scale. If the hardness of the material combination is expressed in the ball indentation hardness (ISO 2039-1), values higher than 250 MPa, preferably higher than 300 MPa are preferred.

With preferred embodiments the basic material reinforced with the filling material comprises an E-modulus higher than 19.000 MPa, preferably higher than 20.000 MPa, and most preferably higher than 21.000 MPa. Providing such E-modulus values prevent that small hairs are embedded between the tweezers such that the clamping force is transmitted from one tweezers element to the other without bringing sufficient pressure to the hairs.

The filling material can be a single material or a material mixture, wherein the filling material comprises at least one of the following components: fibres, ceramics, particularly ceramic powders, aluminium oxide, zirconium oxide, zirconium dioxide, titan oxide, carbon, diamond, glass, Grivory GV, aramid, particularly aramid fibres, natural fillers, particularly natural fibres. As regards natural fillers, for example cotton, hemp or cellulose can be used, preferably together with harder components. Natural fibres can, for example, improve the sound of the whole epilation system, for example by damping the sound of rotating discs that are clapping together.

In accordance with a highly preferred embodiment the basic material is plastic reinforced with 60% glass fibres and 10% ceramic powder. Such a mixture leads to a ball indentation hardness (ISO 2039-1) of 315 MPA and an E-modulus of 22000 MPa.

At least in some cases it is advantageous that the tweezers elements are completely made of the basic material reinforced with the filling material.

Furthermore, it is possible that the tweezers elements are part of clamping portions that are completely made of the basic material reinforced with the filling material.

In this context it is particularly preferred that the tweezers elements are formed by clamping portions of adjacent discs intended to be rotated during operation of the epilator. In such a case the term "clamping portion" denotes those portions of the disc that are periodically in contact with a neighbouring disc during operation of the epilator in order to clamp a hair. The radially outward or circumferential parts of the clamping portions form the tweezers elements. The radially inward parts of the disc can be made softer at least in some cases, wherein the softer parts can form gliding surfaces or tweezers elements supports. The configuration of the tweezers as such can, for example, be as described in WO 01/32048 A1 incorporated by reference herein.

With preferred embodiments the tweezers elements are formed by clamping portions of adjacent discs made by an injection moulding process and intended to be rotated during operation of the epilator.

Without being limited thereto it is preferred for all embodiments that the basic material is plastic.

The above and further aspects and advantages of the invention will be apparent from and elucidated with reference to the embodiment described hereinafter and shown in the drawings.

Figure 1:
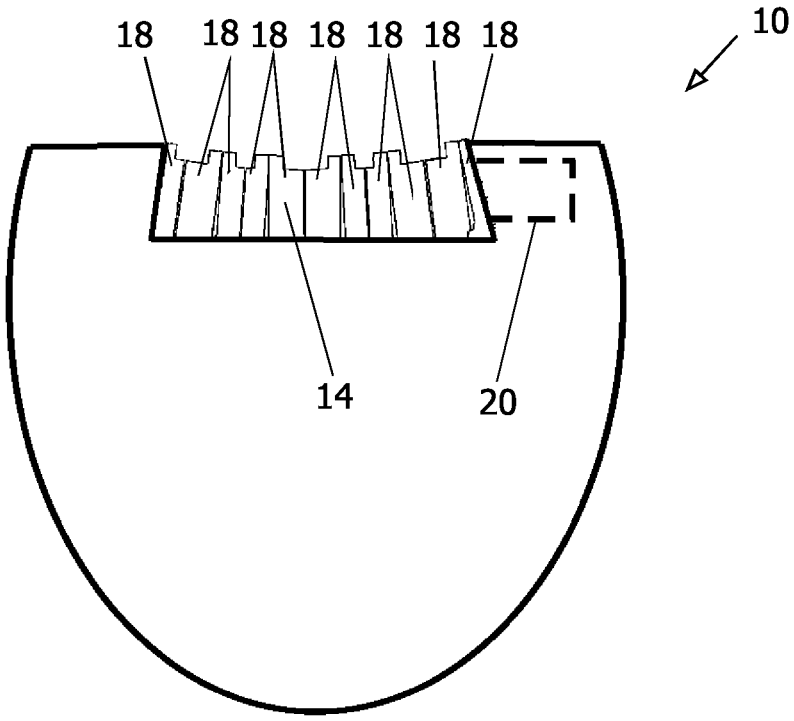
Figure 2:
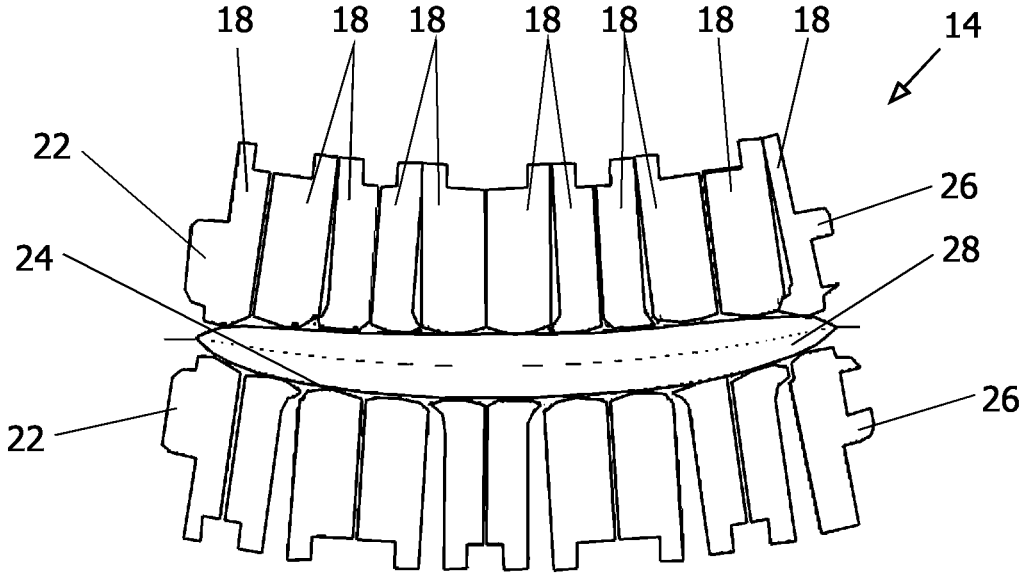
Figure 3:
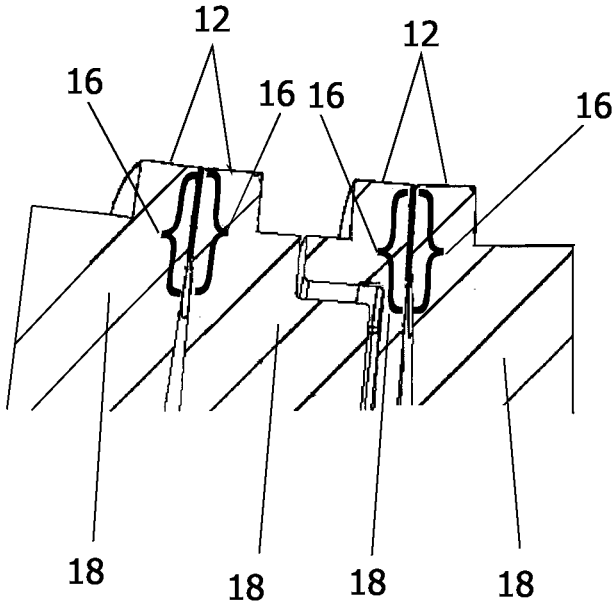
Figure 4:
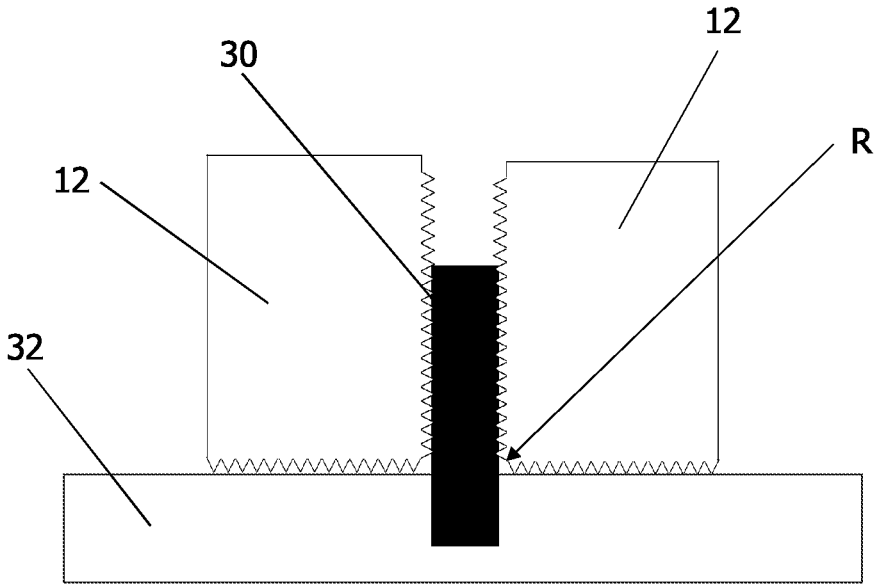

FIG. 1 schematically shows an epilator in accordance with the invention;

FIG. 2 schematically shows a sectional view of a disc assembly, comprising discs which form tweezers elements;

FIG. 3 shows a sectional detail view of four adjacent discs of the disc assembly of FIG. 2;

FIG. 4 schematically shows a tweezers of the epilator shown in FIG. 1; and FIG. 5 schematically shows metal discs in accordance with the prior art.

FIG. 1 schematically shows an epilator in accordance with the present invention. The epilator 10 comprises an epilation opening which enables contact between a disc assembly 14 consisting of a plurality of discs 18. The discs 18 are driven by a drive 20 arranged within the housing of the epilator 10 and indicated by dashed lines.

FIG. 2 schematically shows a sectional view of a disc assembly 14. The illustrated disc assembly 14 consists of eleven discs 18, wherein nine discs 18 are arranged between two end discs. The right end disc comprises side bearing means 26 which are intended to interact with bearing means of the epilator (not shown). The left end disc comprises torque transmitting means 22 which are intended to receive a torque created by the drive 20 (FIG. 1) of the epilator. From FIG. 2 it may also be seen that the centre bores of the disc 18 comprise a diameter which is slightly larger than the diameter of a shaft 28 on which the discs 18 are arranged. This is necessary to enable the necessary pivot motion when the epilator is operated.

FIG. 3 shows a sectional detail view of four adjacent discs 18 of the disc assembly 14 of FIG. 2. From FIG. 3 it may be clearly seen how the contact or clamping surfaces 16 of adjacent discs 18 interact. The clamping portions 16 form tweezers elements 12 at the radially outward regions.

FIG. 4 schematically shows a tweezers of the epilator 10 shown in FIG. 1. Due to the filling material the tweezers elements 12 comprise a rough surface which improves the grip of the hair 30 to be removed from skin 32. Another advantage is that the radii R of the tweezers elements 12 are significantly smaller than the radii of metal discs and can, for example, be in the range of 0.06.

For the embodiment shown in FIGS. 1 to 4 it is preferred that the whole discs are made from plastic reinforced with 60% glass fibres and 10% ceramic powder. However, all materials and material mixtures disclosed in the claims and/or mentioned in the description are also possible.

Equivalents and modifications not described above may also be employed without departing from the scope of the invention, which is defined in the accompanying claims.

The invention claimed is:

1. An epilator comprising:

tweezers elements, wherein at least the surfaces of the tweezers elements are at least in part made of a basic material reinforced with a filling material for 60% to 90%, by weight, the basic material reinforced with the filling material comprising a hardness of at least 3 on Moh's hardness scale, and wherein the filling material comprises at least one of the following components: fibres, ceramics, ceramic powders, aluminum oxide, zirconium oxide, zirconium dioxide, titan oxide, carbon, diamond, glass fibres, aramid, aramid fibres, natural fillers, and natural fibres.

2. The epilator according to claim 1, wherein the basic material reinforced with the filling material on Moh's hardness scale comprises a hardness between 3 and 10.

3. The epilator according to claim 1, wherein the basic material reinforced with the filling material comprises an E-modulus higher than 19.000 MPa.

4. The epilator according to claim 1, wherein the basic material is plastic and reinforced with 60% glass fibres and 10% ceramic powder.

5. The epilator according to claim 1, wherein the tweezers elements are completely made of the basic material reinforced with the filling material.

6. The epilator according to claim 1, wherein the tweezers elements are part of clamping portions that are completely made of the basic material reinforced with the filling material.

7. The epilator according to claim 1, wherein the tweezers elements are formed by clamping portions of adjacent discs intended to be rotated during operation of the epilator.

8. The epilator according to claim 1, wherein the tweezers elements are formed by clamping portions of adjacent discs made by an injection moulding process and intended to be rotated during operation of the epilator.

9. The epilator according to claim 1, wherein the basic material is plastic.

10. The epilator according to claim 1, wherein the filling material of 60%-90%, by weight, provides the surfaces with an improved hair gripping ability that exceeds that of the basic material without the filling material of 60%-90%, by weight.

* * * * *